US011808530B2

(12) United States Patent
Mercer

(10) Patent No.: US 11,808,530 B2
(45) Date of Patent: Nov. 7, 2023

(54) LOUVERED FIN

(71) Applicant: Rheem Manufacturing Company, Atlanta, GA (US)

(72) Inventor: Kevin Mercer, Danville, IN (US)

(73) Assignee: Rheem Manufacturing Company, Atlanta, GA (US)

( * ) Notice: Subject to any disclaimer, the term of this patent is extended or adjusted under 35 U.S.C. 154(b) by 32 days.

(21) Appl. No.: 17/505,827

(22) Filed: Oct. 20, 2021

(65) Prior Publication Data

US 2023/0122925 A1 Apr. 20, 2023

(51) Int. Cl.
*F28F 1/32* (2006.01)
*F25B 39/02* (2006.01)

(52) U.S. Cl.
CPC ..... *F28F 1/325* (2013.01); *F25B 39/02* (2013.01); *F28F 2215/08* (2013.01)

(58) Field of Classification Search
CPC ..... F28F 1/325; F28F 2215/08; F28F 1/128; F28F 1/32; F25B 39/02
See application file for complete search history.

(56) References Cited

U.S. PATENT DOCUMENTS

| | | | | |
|---|---|---|---|---|
| 5,975,198 | A | 11/1999 | Kim et al. | |
| 8,156,999 | B2 | 4/2012 | Ishibashi et al. | |
| 2008/0190588 | A1* | 8/2008 | Heidenreich | F28F 1/325 165/181 |
| 2021/0231343 | A1* | 7/2021 | Matsumoto | F24F 1/32 |

FOREIGN PATENT DOCUMENTS

| | | | | |
|---|---|---|---|---|
| DE | 3841180 | C1 | 4/1990 | |
| EP | 1837608 | A1 | 9/2007 | |
| JP | 61243292 | A * | 10/1986 | F28F 1/325 |
| JP | S61243292 | A | 10/1986 | |
| JP | H0796994 | B2 | 10/1995 | |
| JP | 2007024419 | A | 2/2007 | |

OTHER PUBLICATIONS

Pdf is translation of foreign reference JP-61243292-A (Year: 1986).*
PCT, "International Search Report & Written Opinion" Application No. PCT/US2022/046079, dated Dec. 23, 2022, 15 pages.

* cited by examiner

*Primary Examiner* — Len Tran
*Assistant Examiner* — Kamran Tavakoldavani
(74) *Attorney, Agent, or Firm* — Eversheds Sutherland (US) LLP

(57) ABSTRACT

The present disclosure provides a louvered fin including a leading edge, a trailing edge, and a surface extending between the leading edge and the trailing edge. The surface defines a first set of holes along a first axis, a second set of holes along a second axis and offset from the first set of holes, and a third set of holes along a third axis and offset from the second set of holes. Each of the first axis, the second axis, and the third axis extends substantially parallel to a longitudinal axis of the fin. A first offset distance between the second and first set of holes is greater than a second offset distance between the third and second set of holes. The second and the third set of holes define a substantially obtuse trapezoidal matrix.

20 Claims, 8 Drawing Sheets

LOUVERED FIN

TECHNICAL FIELD

The present disclosure relates, in general, to a heat exchanger fin and, more specifically relates, to a louvered fin for an evaporator coil.

BACKGROUND

Typically, condenser coil and the evaporator coil are each designed as heat exchanger with internal tubing for carrying refrigerant. Each of the condenser coil and the evaporator coil often includes a plurality of fins disposed along a length of the internal tubing, such that adjacent fins are substantially parallel to each other and located apart by a predefined distance. Further, the internal tubing passes through holes defined in the adjacently located fins.

Generally, the condenser coil and the evaporator coil include fins with substantially similar constructional features. Although such similarity in constructional features aid streamlined manufacturing, performance of the fin, such as heat transfer efficiency, may be affected by using similar fins in each of the condenser coil and the evaporator coil. It is required to incorporate condensate management features in the fins implemented in the evaporator coil, while the same may not be a mandate for the condenser coil. As such, design of fins may be optimized for better performance based on end-use application.

SUMMARY

According to one aspect of the present disclosure, a louvered fin is disclosed. The louvered fin includes a leading edge, a trailing edge opposite to the leading edge, and a surface extending between the leading edge and the trailing edge. The surface defines a plurality of holes, in which a first set of holes are defined along a first axis, a second set of holes are defined along a second axis, and a third set of holes are defined along a third axis. Each of the first axis, the second axis, and the third axis extends substantially parallel to a longitudinal axis of the fin. The second set of holes are offset from the first set of holes along the longitudinal axis of the fin and the third set of holes are offset from the second set of holes along the longitudinal axis of the fin. A first offset distance defined between the second set of holes and the first set of holes is greater than a second offset distance defined between the third set of holes and the second set of holes. The second set of holes and the third set of holes define a substantially obtuse trapezoidal matrix.

In an embodiment, the louvered fin further includes a fourth set of holes defined along a fourth axis extending substantially parallel to the longitudinal axis of the fin.

In an embodiment, the surface extending between the leading edge and the trailing edge is wavy. In an embodiment, each of two opposite wider angles of the obtuse trapezoidal matrix is in a range of about 95 degrees to about 105 degrees.

In an embodiment, a distance between the leading edge and the first axis is in a range of about 0.25 inch to about 0.5 inch. In an embodiment, a distance between the first axis and the second axis is in a range of about 0.50 inch to about 1 inch. In an embodiment, a distance between the third axis and the trailing edge is in a range of about 0.25 inch to about 0.5 inch. In an embodiment, a distance between two adjacent holes of the first set of holes is in a range of about 1 inch to about 0.75 inch.

In an embodiment, a distance between two adjacent holes of the second set of holes is in a range of about 1 inch to about 0.75 inch. In an embodiment, the first offset distance between the first axis and the second axis of holes is in a range of about 0.375 inch to about 0.5 inch. In an embodiment, a diameter of each hole of the first set of holes, the second set of holes, and the third set of holes is in a range of about 6.8 mm to about 4.8 mm.

In an embodiment, the louver fin further includes a plurality of collars, where each collar extends from a periphery of one hole of the plurality of holes. Preferably, each collar extends in a direction perpendicular to the surface of the fin. Each collar includes a narrow portion and an expanded portion, where the expanded portion is distal from the surface of the fin.

According to another aspect of the present disclosure, an evaporator coil is disclosed. The evaporator coil includes a plurality of refrigerant tubes and a plurality of louvered fins. Each louvered fin includes a leading edge, a trailing edge opposite to the leading edge, and a surface extending between the leading edge and the trailing edge. The surface defines a plurality of holes configured to allow the plurality of refrigerant tubes to pass therethrough. A first set of holes of the plurality of holes are defined along a first axis, a second set of holes of the plurality of holes are defined along a second axis, and a third set of holes of the plurality of holes are defined along a third axis. Each of the first axis, the second axis, and the third axis extends substantially parallel to a longitudinal axis of the fin. The second set of holes are offset from the first set of holes along the longitudinal axis of the fin and the third set of holes are offset from the second set of holes along the longitudinal axis of the fin. A first offset distance defined between the second set of holes and the first set of holes is greater than a second offset distance defined between the third set of holes and the second set of holes. The second set of holes and the third set of holes define a substantially obtuse trapezoidal matrix.

In an embodiment, each of the plurality of louvered fins is made from aluminum alloy. In an embodiment, each of the plurality of holes forms an interference fit with an outer surface of a refrigerant tube passing therethrough.

In an embodiment, each of the plurality of louvered fins defines at least one cropped corner. In an embodiment, each of the plurality of louvered fins further includes gagged regions located around peripheries of the hole defined proximal to the at least one cropped corner.

In an embodiment, the evaporator coil further includes a plurality of collars, where each collar extends from a periphery of one hole of the plurality of holes. A length of each collar is in a range of about 1.4 mm to about 1.8 mm.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

As used herein, the terms "a", "an" and the like generally carry a meaning of "one or more," unless stated otherwise. Further, the terms "approximately", "approximate", "about", and similar terms generally refer to ranges that include the identified value within a margin of 20%, 10%, or preferably 5%, and any values therebetween.

Aspects of the present disclosure are directed to a louvered fin and an evaporator coil implementing the louvered fin. The louvered fin has a unique design to aid enhanced condensate drainage and enable structural robustness. Additionally, configuration of louvers in the fin form boundary layers of convective heat transfer between air flowing, with an inclined angle of attack, across small diameter tubes extending across the fins.

Figure 1B:
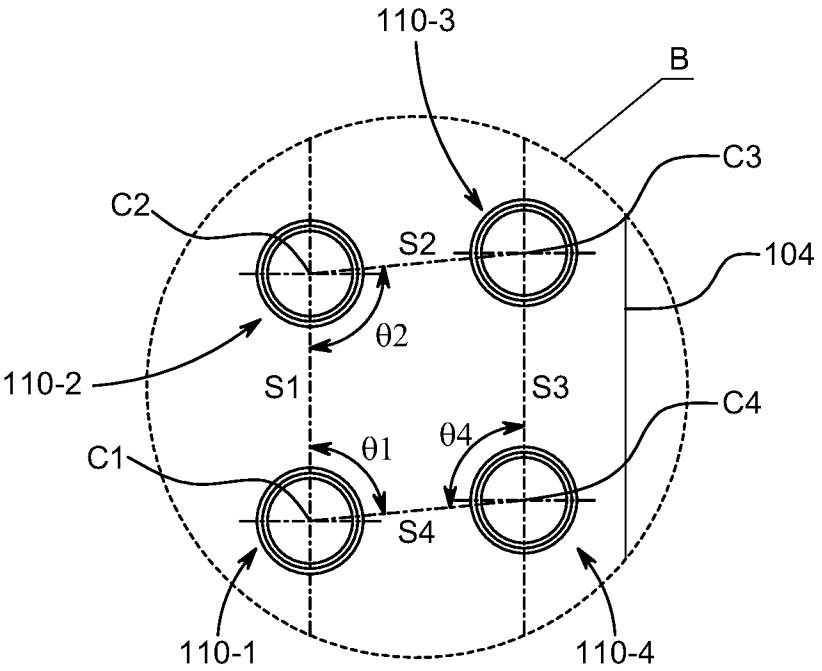
FIG. 1B is an enlarged view of a portion of the louvered fin of FIG. 1A, according to an embodiment of the present disclosure.
Figure 1A:
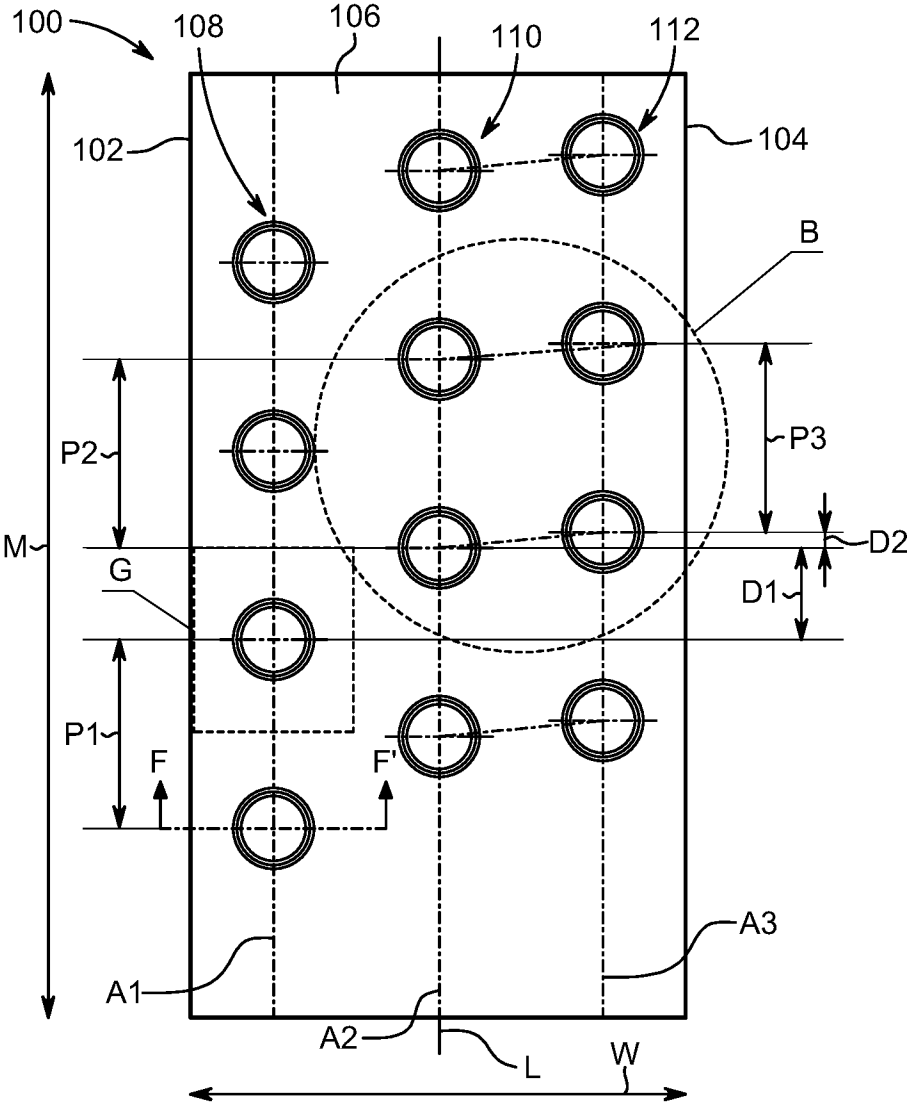
FIG. 1A is a front view of a louvered fin, according to an embodiment of the present disclosure.

Referring to FIG. 1A, a front view of a louvered fin 100 is illustrated, according to an embodiment of the present disclosure. The louvered fin 100 (hereinafter referred to as "the fin 100") includes a leading edge 102 and a trailing edge 104 opposite to the leading edge 102. As used herein, the term "leading edge" refers to a feature of the fin 100 that is upstream with respect to a direction of flow of air across the fin 100 and the term "trailing edge" refers to a feature of the fin 100 that is relatively downstream with respect to the direction of flow of air across the fin 100. These terminologies are well known in the art of fins, for example heat exchanger fins. The fin 100 further includes a surface 106 extending between the leading edge 102 and the trailing edge 104. Preferably, the surface 106 is wavy in structure. As used herein, the term "wavy" refers to a structure of the fin 100 including adjacent concave and convex portions, or multiple crests and troughs, along a width "W" of the fin 100. In an embodiment, a length "M" of the fin 100 may be in a range of about 3.8 inches to about 4.5 inches and the width "W" of the fin 100 may be in a range of about 1.9 inches to about 2.5 inches. According to an aspect of the present disclosure, multiple fins, each having a configuration described below, are stacked to constitute a heat exchanging medium of an evaporator coil. The fin 100 may also be suitably implemented in, but not limited to, indoor air handler of residential split systems, both heat pumps and air conditioners.

Further, the surface 106 of the fin 100 defines a plurality of holes including a first set of holes 108, a second set of holes 110, and a third set of holes 112. Each of the plurality of holes is configured to allow a refrigerant tube (not shown) of the evaporator coil to pass therethrough. The phrase "set of holes" may be alternatively referred and understood as "row of holes". In an embodiment, a diameter of each hole of the first set of holes 108, the second set of holes 110, and the third set of holes 112 is in a range of about 4.8 mm to about 6.8 mm, and preferably 7 mm. According to an aspect of the present disclosure, the fin 100 preferably includes three rows of holes as illustrated in FIG. 1A. The first set of holes 108 are defined along a first axis "A1" located proximal to the leading edge 102 of the fin 100. In an embodiment, a distance between the leading edge 102 and the first axis "A1" is in a range of about 0.25 inch to about 0.5 inch. In another embodiment, the distance between the leading edge 102 and the first axis "A1" is preferably 0.3625 inch. Further, in an embodiment, a distance between two adjacent holes of the first set of holes 108, which defines a first pitch "P1", is in a range of about 0.75 inch to about 1 inch. In some embodiments, preferably, the first pitch "P1" along the first axis "A1" is 0.827 inch.

The second set of holes 110 are defined along a second axis "A2" and are offset from the first set of holes 108 along a longitudinal axis "L" of the fin 100. The second axis "A2" extends along the longitudinal axis "L" and is located between the first axis "A1" and the trailing edge 104. For the purpose of brevity, the second axis "A2" is shown coinciding with the longitudinal axis "L". In an embodiment, a distance between the first axis "A1" and the second axis "A2" is in a range of about 0.50 inch to about 1 inch. In another embodiment, distance between the first axis "A1" and the second axis "A2" is preferably 0.725 inch. Further, in an embodiment, a distance between two adjacent holes of the second set of holes 110, which defines a second pitch "P2", is in a range of about 0.75 inch to about 1 inch. In some embodiments, preferably, the second pitch "P2" along the second axis "A2" is 0.827 inch.

Further, the third set of holes 112 are defined along a third axis "A3" that is located proximal to the trailing edge 104 of the fin 100. In an embodiment, a distance between the third axis "A3" and the trailing edge 104 is in a range of about 0.25 inch to about 0.5 inch. In another embodiment, the distance between the third axis "A3" and the trailing edge 104 is preferably 0.3625 inch. The third set of holes 112 are offset from the second set of holes 110 along the longitudinal axis "L" of the fin 100. Further, in an embodiment, a distance between two adjacent holes of the third set of holes 112, which defines a third pitch "P3", is in a range of about 0.75 inch to about 1 inch. In some embodiments, preferably, the third pitch "P3" along the third axis "A3" is 0.827 inch. Each of the first axis "A1", the second axis "A2", and the third axis "A3" extends substantially parallel to the longitudinal axis "L" of the fin 100.

The second set of holes 110 are offset at a first offset distance "D1" from the first set of holes 108 and the third set of holes 112 are offset at a second offset distance "D2" from the first set of holes 108. Preferably, the second offset distance "D2" is less than the first offset distance "D1". In an embodiment, the first offset distance "D1" is in a range of about 0.375 inch to about 0.5 inch. In some embodiment, the first offset distance "D1" preferably is 0.4135 inch. For the purpose of the present disclosure, the offset distances are calculated with respect to centers of the holes as indicated in the FIG. 1A.

FIG. 1B is an enlarged view of a portion "B" of FIG. 1A, according to an embodiment of the present disclosure. As can be seen from FIG. 1B, the third set of holes 112 are offset from the second set of holes 110 along the longitudinal axis "L". As such, the second set of holes 110 and the third set of holes 112 define a substantially obtuse trapezoidal matrix. An obtuse trapezoid refers to a geometric shape including one acute angle and one obtuse angle defined on a base thereof. For example, centers "C1" of a first hole 110-1, "C2" of a second hole 110-2, "C3" of a third hole 112-1, and "C4" of a fourth hole 112-2 define vertices of the obtuse trapezoid. Line segments "S1" extending between "C1" and "C2", "S2" extending between "C2" and "C3", "S3" extending between "C3" and "C4", and "S4" extending between "C4" and "C1" define sides of the obtuse trapezoid. Line segments "S1" and "S4" define an acute angle "θ1", "S1" and "S2" define an obtuse angle "θ2", and similarly "S3" and "S4" define an obtuse angle "θ4". As such, "θ2" and "θ4" are two opposite wider angles of the obtuse trapezoid. In an embodiment, each of the two opposite wider angles of the obtuse trapezoid is in a range of about 95 degrees to about 105 degrees. Similarly, adjacent set of four holes define another obtuse trapezoid. As such, owing to the offset, the second set of holes 110 and the third set of holes 112 define an array of obtuse trapezoids along the longitudinal axis "L" of the fin 100, which together constitutes the obtuse trapezoidal matrix.

Figure 1C:
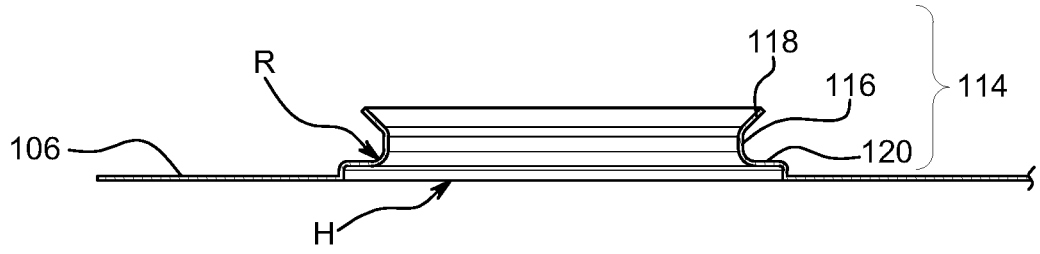
FIG. 1C is a cross-section of a portion of the louvered fin of FIG. 1A, according to an embodiment of the present disclosure.

FIG. 1C illustrates a cross-section of a portion of the fin 100 considered along a section F-F' in FIG. 1A. In an embodiment, the fin 100 further includes a plurality of collars, where each collar extends from a periphery of one hole of the plurality of holes. As shown in FIG. 1C, a collar 114 extends from the periphery of the hole "H" defined in the surface 106 of the fin 100. Particularly, each collar, such as the collar 114, extends in a direction perpendicular to the surface 106 of the fin 100. In an embodiment, the collar 114 includes a narrow portion 116 and an expanded portion 118 extending from the narrow portion 116. The expanded portion 118 is distal from the surface 106 of the fin 100. The collar 114 narrows from the periphery of the hole "H" to the narrow portion 116 through a step portion 120. In order to minimize stress concentration in the collar 114, the narrow portion 116 and the step portion 120 defines a fillet at a connection portion thereof, having a radius of curvature "R". In an embodiment, a length of each collar is in a range of about 1.4 mm to about 1.8 mm. However, in some embodiments, the length of the collar 114 may be determined based on fins-per-inch factor of the evaporator coil.

According to an aspect, each of the plurality of holes forms an interference fit with an outer surface of the refrigerant tube passing therethrough. For the sake of brevity in illustration and description, the evaporator coil and the refrigerant tubes are not illustrated and particularly described as they are well known in the art. The collar 114, and other collars formed in the fin 100, serve to increase mechanical strength of a joinder, such as the interference fit, between the fin 100 and the corresponding refrigerant tube. The collar 114 also serves to increase the heat conductivity between the refrigerant tubes and the fin 100. In some embodiments, the surface 106 of the fin 100, the refrigerant tubes, and the collar 106 may each be manufactured from a suitable thermally-conductive material, such as, but not limited to, copper, aluminum, and alloys thereof. In the present disclosure, the fin 100 is made from aluminum alloy.

Figure 2:
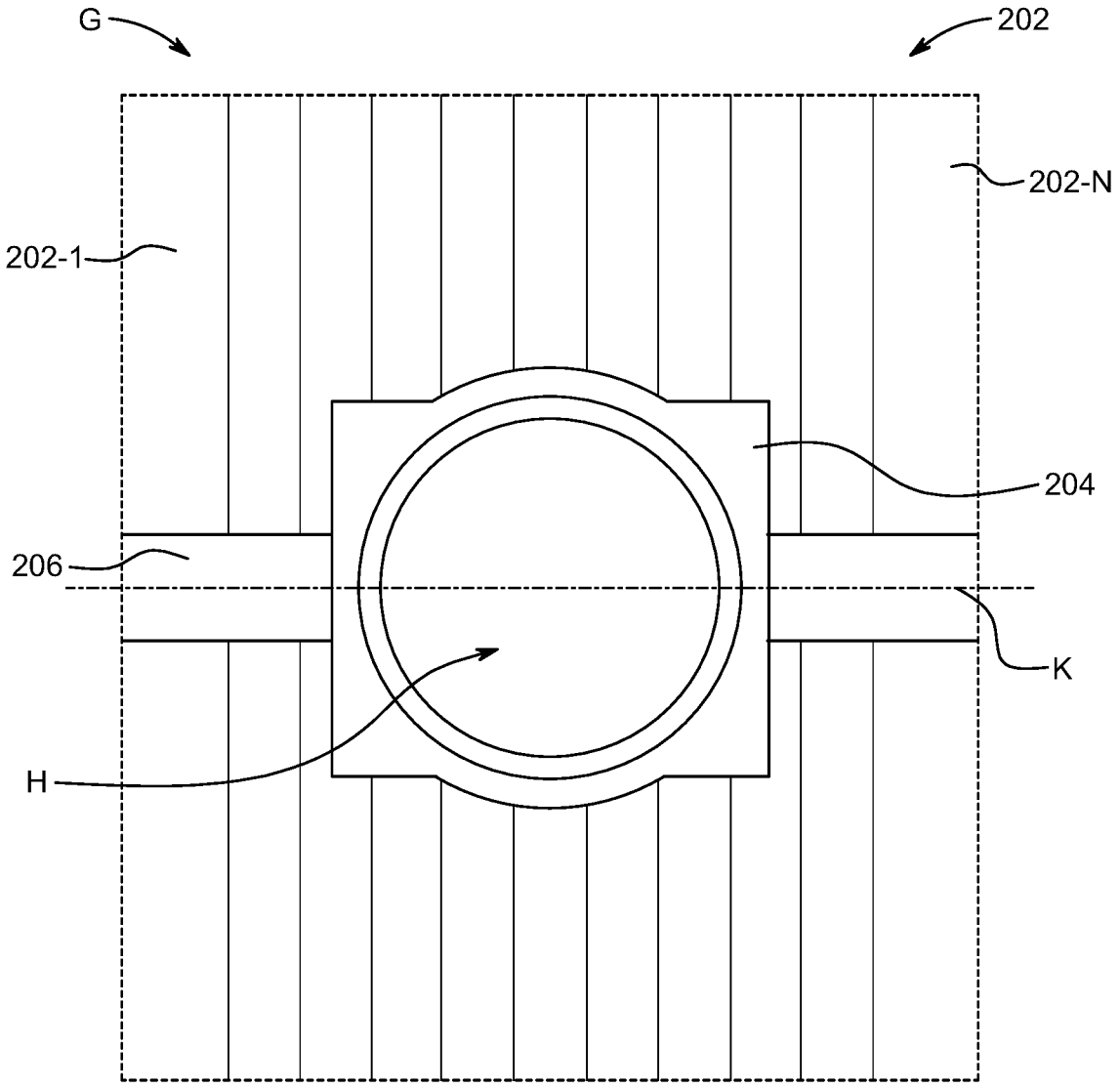
FIG. 2 is an enlarged portion of the louvered fin of FIG. 1A, according to an embodiment of the present disclosure.

FIG. 2 illustrates an enlarged portion "G" of FIG. 1A. Particularly, the enlarged portion "G" includes the hole "H" of the first set of holes 108. The fin 100 includes a plurality of louvers 202 extending along the longitudinal axis "L" of the fin 100. In an embodiment, the fin 100 includes a predefined region 204 around the hole "H" configured, for example, to add to the strength of the collar 114 extending from the periphery of the hole "H". As can be seen in FIG. 2, the predefined region 204 includes a rectangular portion, where a pair of opposite sides of the rectangular portion includes an arcuate portion. Along a horizontal axis "K", the fin 100 includes a sleeve 206 free from the louvers 202. In other words, the louvers 202 are not formed in the sleeve 206. Additionally, the predefined region 204 is also free from the louvers 202. When the refrigerant pipe is inserted through the hole "H", the predefined region 204 and the sleeve 206 may together add strength to the collar 114 extending from the periphery of the hole "H", which otherwise would be weak if the louvers 202 were extending up to the collar 114. In an example, a width of the sleeve 206 may be about 2 mm. The louvers 202 at extremities, such as a left extreme louver 202-1 and a right extreme louver 202-N, are wider as compared to intermediate louvers located therebetween. In an example, width of each of louver at the extremities may be about 2.25 mm and width of each intermediate louver may be about 1.5 mm. In some embodiments, the fin 100 may include nine intermediate louvers. FIG. 2 illustrates the louvers 202 associated with the first set of holes 108. The second set of holes 110 and third set of holes 112 are neighbored by similar set of louvers 202. In some embodiments, number of louvers associated with each row of holes may be equal, for example 11 louvers as illustrated in FIG. 2. In some embodiments, the number of louvers may vary between adjacent rows of holes.

Figure 3:
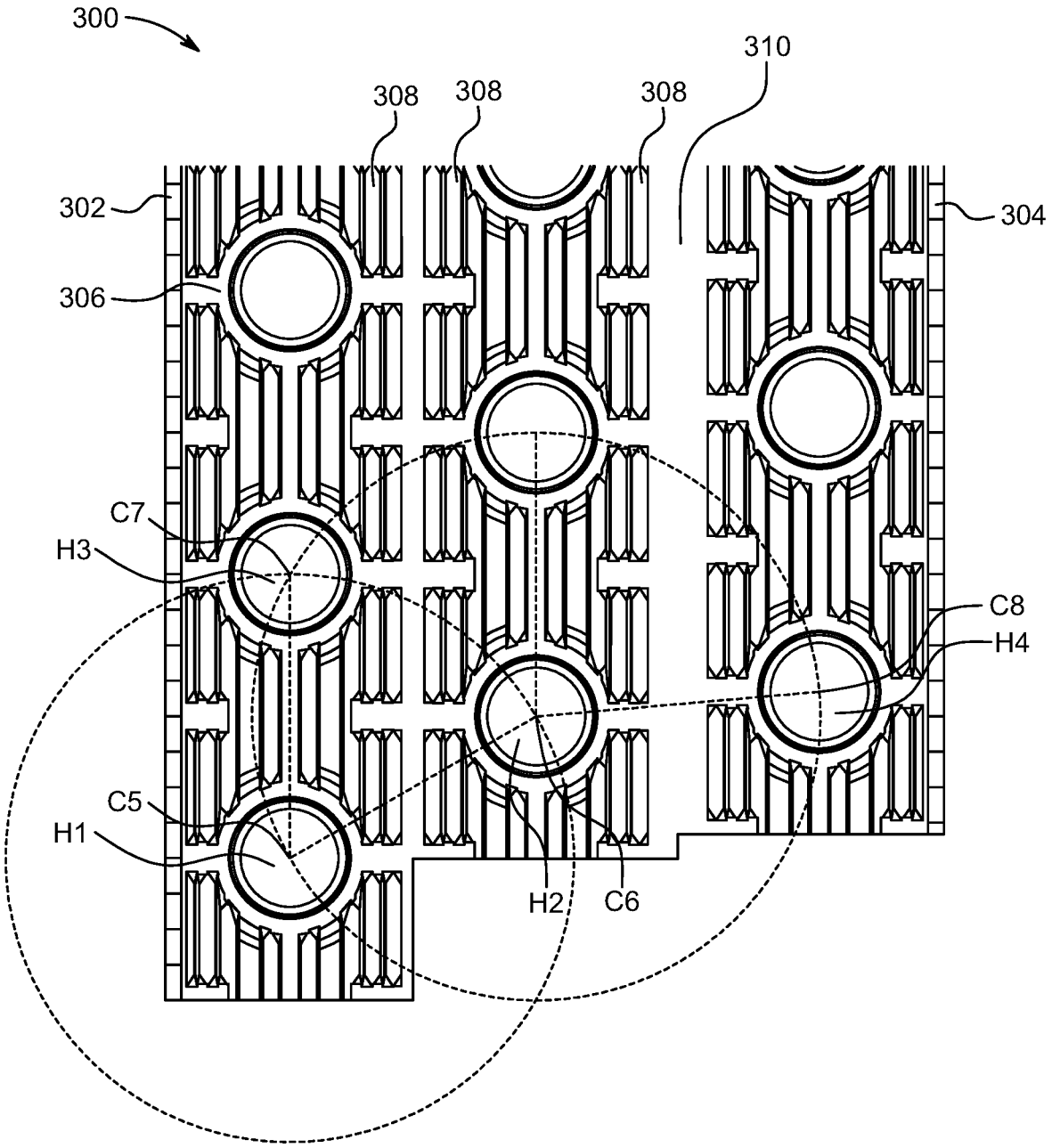
FIG. 3 is a portion of another louvered fin, according to another embodiment of the present disclosure.
Figure 5:
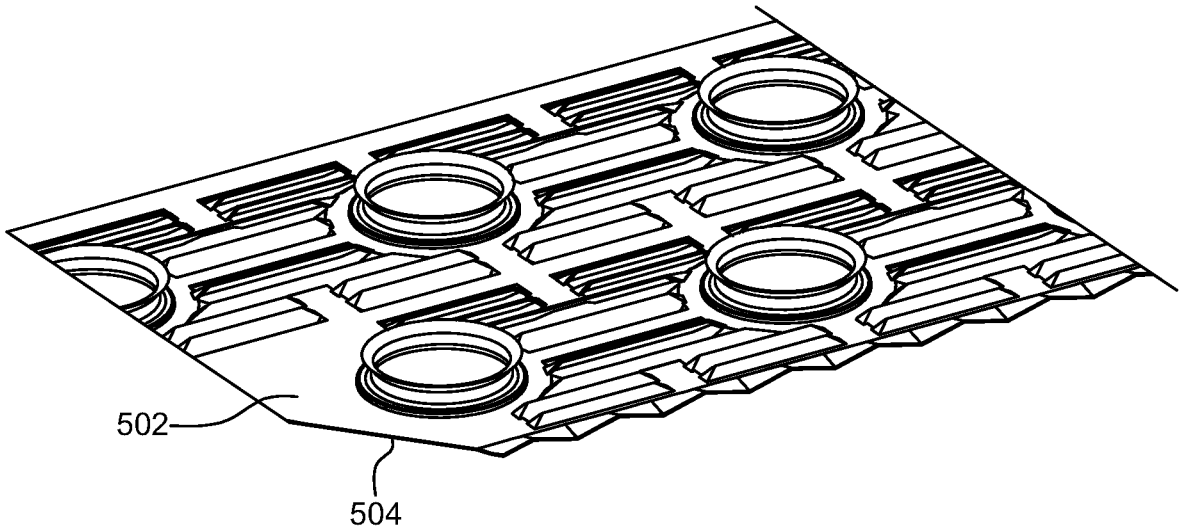
FIG. 5 is an enlarged portion of the louvered fin of FIG. 3, according to an embodiment of the present disclosure.

FIG. 3 illustrates a portion of a fin 300, according to another embodiment of the present disclosure. Each of a leading edge 302 and a trailing edge 304 of the fin 300 has a rippled edge, such as a zig-zag pattern (as shown in FIG. 5). A predefined region 306 extends around a circumference of each hole of each row of holes. In an embodiment, louvers 308 are formed to define an X-shape pattern along a surface 310 of the fin 300. In the illustrated embodiment, the fin 300 includes ten louvers 308. In other embodiments, the fin 300 may include any number of louvers 300 based on a width and pitch of the fin 300. Besides being offset, the holes of the second row are defined at a radial distance from the holes of the first row. For example, a distance between center "C5" of a first hole "H1" in the first row of holes and center "C6" of a first hole "H2" in the second row of holes is 21 mm. A circumference of an imaginary circle considered with "C5" as the center, passes through center "C7" of a second hole "H3" in the first set of holes. As such, the center "C7" is also at radial distance from the center "C5", thereby defining the pitch of the fin 300. Similarly, a circumference of another imaginary circle considered with "C6" as the center, passes through center "C8" of a first hole "H4" of the third row of holes and the center "C5" of the first hole "H1" of the first row of holes. As such, the third row of holes are also defined at the same radial distance from the second row of holes. Such design of the fin 300, and that of the fin 100 of FIG. 1A, may eliminate overlap of holes and louvers with adjacent row of holes and louvers, thereby achieving an increase in heat transfer efficiency.

Figure 4:
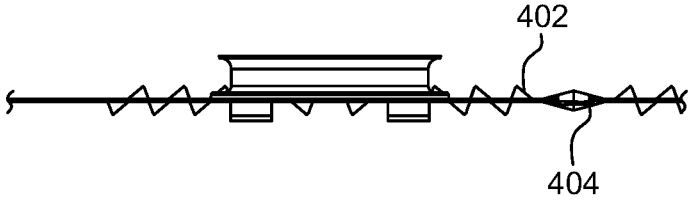
FIG. 4 is a side view of the louvered fin of FIG. 3, according to an embodiment of the present disclosure.

FIG. 4 illustrates a side view of the fin 300. In an embodiment, the fin 300 includes half louvers 402 at the edges of the fin 300, such as the leading edge 302 and the trailing edge 304, and full louvers at remaining portion of the surface 310 of the fin 300. As used herein, the term "full louver" refers to complete length of the louver extending across the surface 310 of the fin 300 and the term "half louver" refers to half length of the louver extending from the surface 310 of the fin 300. FIG. 4 also shows a joint 404 formed between two fins. At the joint 404, the trailing edge of one fin contacts a leading edge of an adjacent fin. Conventional joining processes known to a person skilled in the art to join the rippled edges of the contacting portions of the two fins may be performed to achieve a wider fin array (not shown). In an embodiment, the louvers 308 extend at an angle of about 45 degrees with respect to the surface 310 of the fin 300. In other embodiments, the louvers 308 may be inclined at any preferred acute angle.

FIG. 5 illustrates a portion of the fin 300, according to another embodiment of the present disclosure. The louvers 308 extending till an end of the fin 300 may be subjected to damage or may be directed in random directions during assemblage into the evaporator coil. In order to overcome such damage, in an embodiment, the fin 300 includes gagged regions 502 around the peripheries of the holes defined proximal to the ends of the fin 300. Preferably, the gagged regions 502 are formed around the holes defined proximal to at least one cropped corner 504 in the fin 300. The gagged portions 502 do not include any louvers 308 and hence may add to the strength of the fin 300 at the cropped corner 504.

Figure 6A:
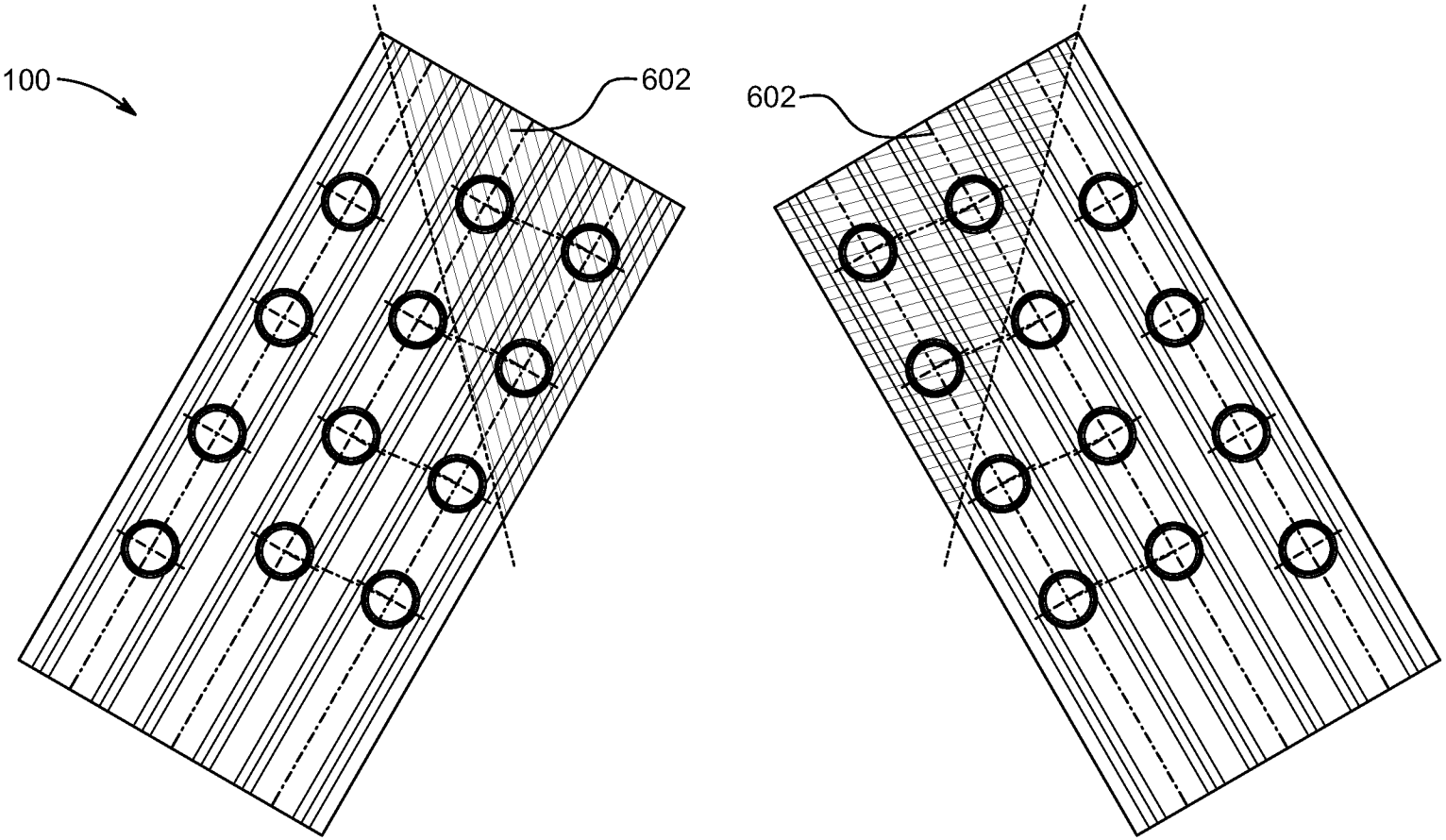
FIG. 6A shows louvered fin having a cropped corner, according to an embodiment of the present disclosure.
Figure 6B:
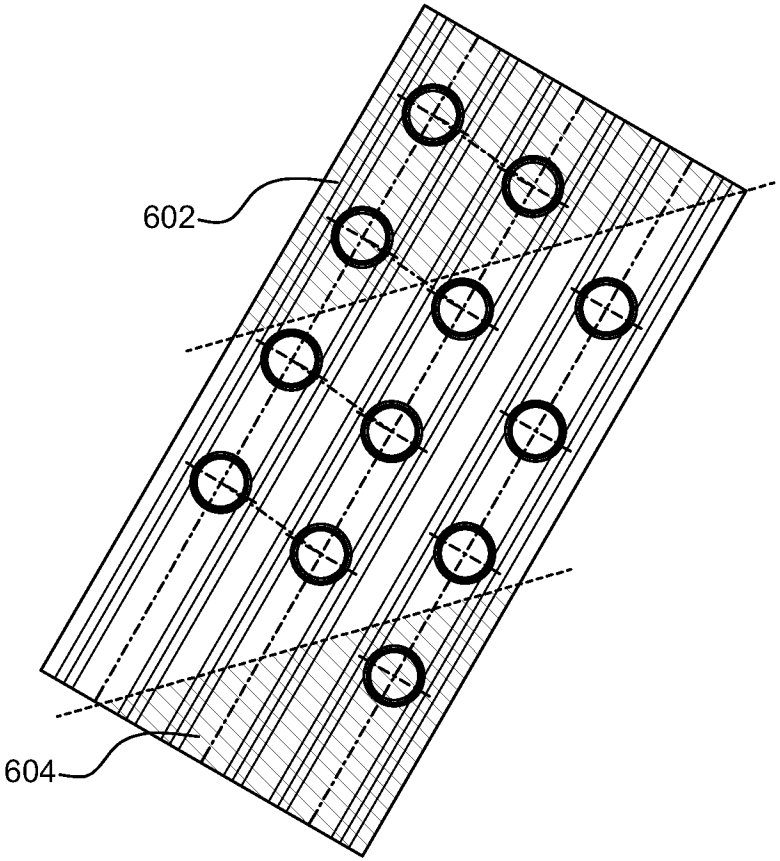
FIG. 6B shows louvered fin having a pair of cropped corners, according to an embodiment of the present disclosure.
Figure 6B:
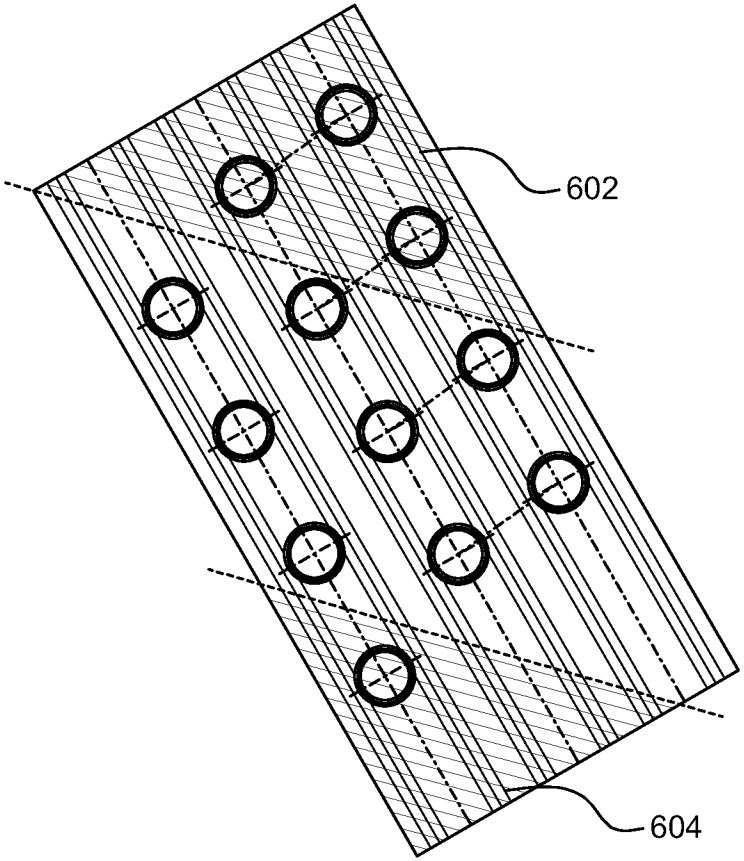

FIGS. 6A and 6B illustrates fins showing cropped corners. Particularly, FIG. 6A illustrates fins, such as the fin 100, 300, with corners designated for cropping. Hatched portions 602 are indicative of corners that are designated for cropping. The fins are positioned in an inclined manner, for example along arms of alphabet "A". Multiple such fins may be stacked together to constitute a "A-type" evaporator coil. The cropped corners aid in reducing the size of such evaporator coils, in case of space constraints in an end-use application. FIG. 6B illustrates a pair of hatched portions 602, 604 designated for cropping in each fin. The fins in FIG. 6B are oriented in an inclined manner, for example along arms of alphabet "V". Multiple such fins with double cropped corners may be stacked to constitute a smaller evaporator coil based on space available in the end-use application. As such, the fins may be configured to constitute the evaporator coil of desired shape and size. In some embodiments, "N-type", "Z-type", or slab type evaporator coils may be formed in similar manner by positioning the fins, with or without cropped corners, in inclined manner and stacking with refrigerant pipes. However, it may be ensured that cutting line(s) to form the cropped corners does not interfere with the holes defined in the fins and does not lie close to the periphery of the holes. It will be understood to the person skilled in the art that the louvers at the cropped corners need to be handled carefully while stacking multiple such fins to constitute the evaporator coil. In some embodiment, the fins with cropped corners may include gagged regions, such as the regions 502, around the peripheries of the hole defines proximal to the cropped corners. In some embodiments, the fin may include two or more cropped corners.

Figure 7A:
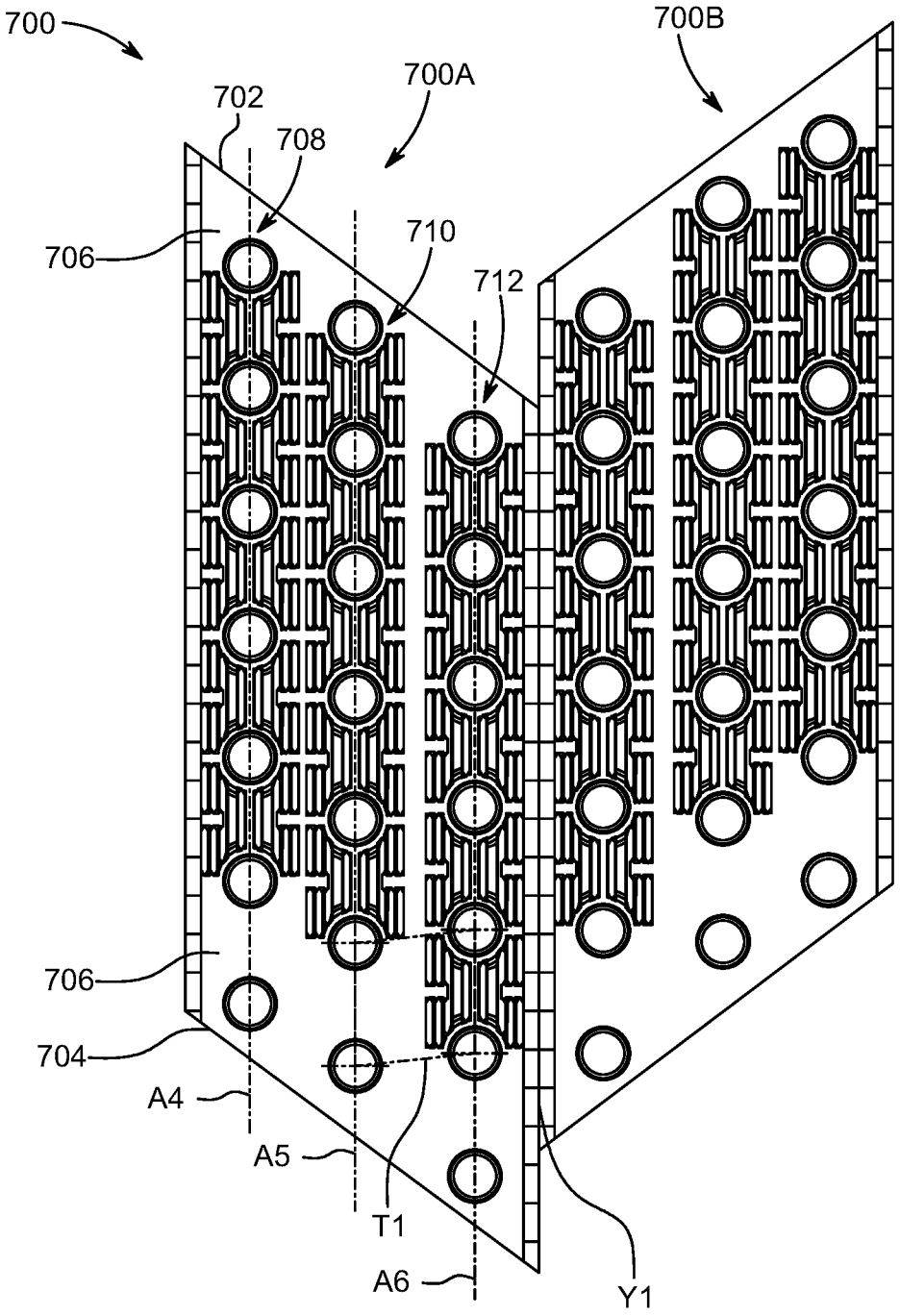
FIG. 7A is a front view of a louvered fin defining three rows of holes, and having cropped corners and gagged regions, according to another embodiment of the present disclosure.

FIG. 7A illustrates a front view of a louvered fin 700, according to another embodiment of the present disclosure. Preferably, two fins 700A and 700B may be die stamped on an aluminum sheet to achieve the design illustrated in FIG. 7A. Further, the fin 700A may be separated from the fin 700B, by known means, along a line of contact "Y1". Upon separation, multiple such fins may be disposed adjacent to each other and may be stacked together with refrigerant tubes. Each of the fins 700A, 700B includes three rows of holes defined between cropped corners 702, 704, and gagged regions 706 around holes defined proximal to the cropped corners 702, 704. For the purpose of brevity, configuration of the fin 700A is described herein. A first row of holes 708 is defined along a first axis "A4", a second row of holes 710 is defined along a second axis "A5", and a third row of holes 712 is defined along a third axis "A6". Each axis extends substantially parallel to a longitudinal axis of the fin 700A. The second row of holes 710 are offset from the first row of holes 708 in a direction along a length of the fin 700A, and the third row of holes 712 are offset from the second row of holes 710 in the direction along the length of the fin 700A. The second row of holes 710 and the third row of holes define a substantially obtuse trapezoidal matrix. For the purpose of illustration, one obtuse trapezoid "T1" is indicated in fin 700A. Interior angles each obtuse trapezoid formed in the fin 700A may preferably be equal to those described with respect to FIG. 1B.

Figure 7B:
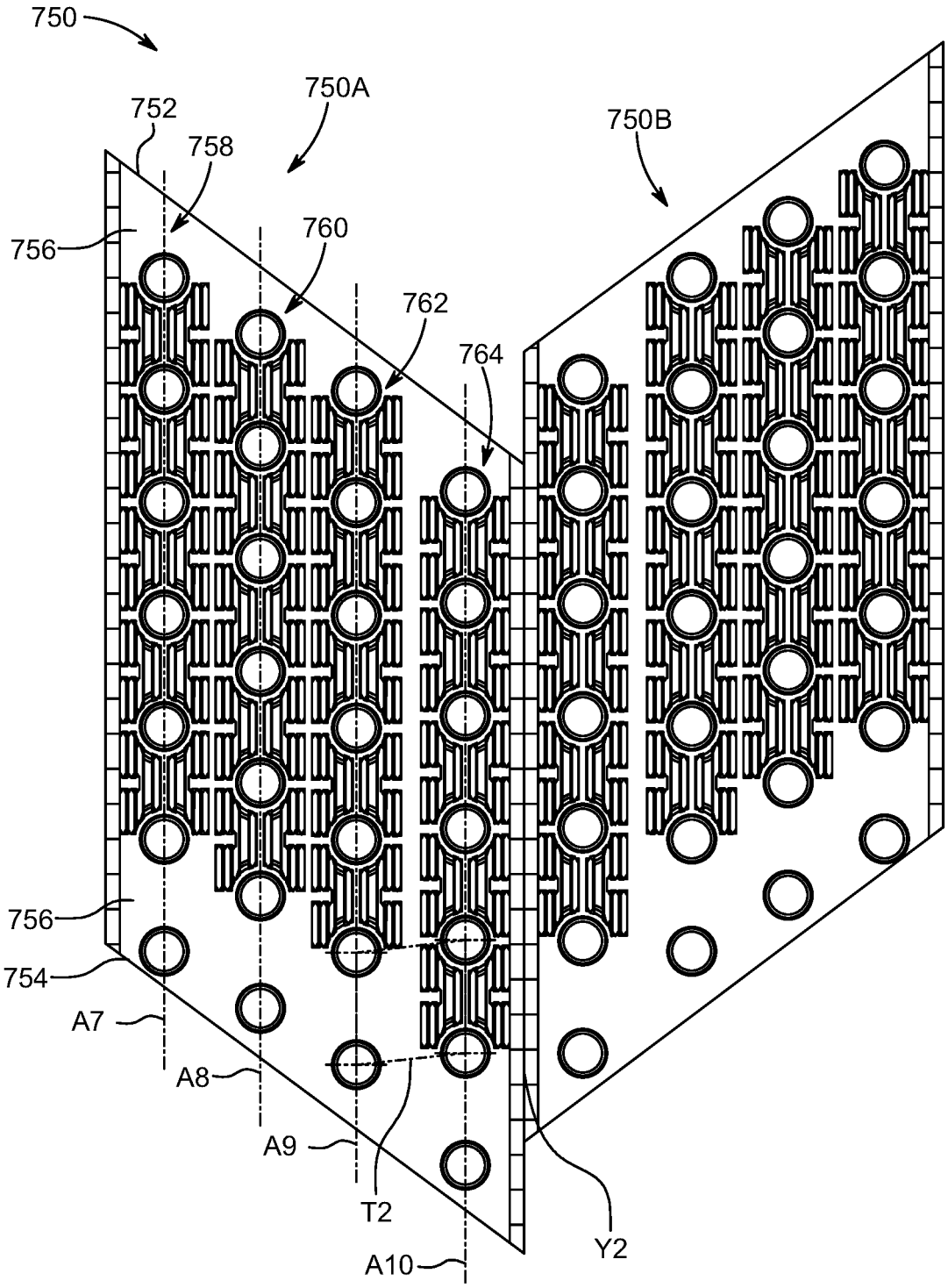
FIG. 7B is a front view of a louvered fin defining four rows of holes, and having cropped corners and gagged regions, according to another embodiment of the present disclosure.

FIG. 7B illustrates a front view of a louvered fin 750, according to another embodiment of the present disclosure. Preferably, two fins 750A and 750B may be die stamped on an aluminum sheet to achieve the design illustrated in FIG. 7B. Further, the fin 750A may be separated from the fin 750B, by known means, along a line of contact "Y2". Upon separation, multiple such fins may be disposed adjacent to each other and may be stacked together with refrigerant tubes. Each of the fins 750A, 750B includes four rows of holes defined between cropped corners 752, 754, and gagged regions 756 around holes defined proximal to the cropped corners 752, 754. For the purpose of brevity, configuration of the fin 750A is described herein. The fin 750A includes a first row of holes 758 defined along a first axis "A7", a second row of holes 760 defined along a second axis "A8" and offset from the first row of holes 758, a third row of holes 762 defined along a this axis "A9" and offset from the second row of holes 760, and a fourth row of holes 764 defined along a fourth axis "A10" and offset from the third row of holes 762. Each axis extends substantially parallel to a longitudinal axis of the fin 750A. Geometrically, the third row of holes 760 and the fourth row of holes 762 define a substantially obtuse trapezoidal matrix. For the purpose of illustration, one obtuse trapezoid "T2" is indicated in fin 750A. Interior angles each obtuse trapezoid formed in the fin 750A may preferably be equal to those described with respect to FIG. 1B.

To this end, the present disclosure provides a unique design for louvered fins. The design of the louvered fin is particularly optimized for condensate draining, utilizing larger louver angle, but implementing plurality of louvers in contrast to conventional lanced fin. With such configuration of the louvered fin, it is possible to maintain a high convective heat transfer coefficient. Besides contributing for good condensate drainage, the louvered fin of the present disclosure also restarts boundary layers of convective heat transfer with small diameter refrigerant tubes, for example 7 mm tubes, at an inclined angle of attack for the airflow across the louvered fins. Additionally, the geometrical characteristics of the louvered fin, such as the obtuse trapezoidal matrix of the holes, may aid easy draining of condensate.

While aspects of the present disclosure have been particularly shown and described with reference to the embodiments above, it will be understood by those skilled in the art that various additional embodiments may be contemplated by the modification of the disclosed features without departing from the spirit and scope of what is disclosed. Such embodiments should be understood to fall within the scope of the present disclosure as determined based upon the claims and any equivalents thereof.

What is claimed is:

1. A louvered fin comprising:

a leading edge;

a trailing edge opposite to the leading edge; and a surface extending between the leading edge and the trailing edge, the surface defining a plurality of holes, wherein:

a first set of holes are defined along a first axis;

a second set of holes are defined along a second axis, wherein the second set of holes are offset from the first set of holes along (i) a longitudinal axis of the louvered fin by a first offset distance, and (ii) a latitudinal axis of the louvered fin by a second offset distance; and a third set of holes are defined along a third axis, wherein the third set of holes are offset from the second set of holes along (i) the longitudinal axis of the louvered fin by a third offset distance and (ii) the latitudinal axis of the louvered fin by a fourth offset distance, wherein the first offset distance is greater than the third offset distance, and wherein the fourth offset distance is greater than the second offset distance, and wherein the first axis, the second axis, and the third axis extend substantially parallel to the longitudinal axis of the louvered fin; and the second set of holes and the third set of holes define a substantially obtuse trapezoidal matrix.

2. The louvered fin of claim 1 further comprising a fourth set of holes defined along a fourth axis extending substantially parallel to the longitudinal axis of the louvered fin.

3. The louvered fin of claim 1, wherein the surface extending between the leading edge and the trailing edge is wavy.

4. The louvered fin of claim 1, wherein each of two opposite wider angles of the obtuse trapezoidal matrix is in a range of about 95 degrees to about 105 degrees.

5. The louvered fin of claim 1, wherein a distance between the leading edge and the first axis is in a range of about 0.25 inch to about 0.5 inch.

6. The louvered fin of claim 1, wherein a distance between the first axis and the second axis is in a range of about 0.50 inch to about 1 inch.

7. The louvered fin of claim 1, wherein a distance between the third axis and the trailing edge is in a range of about 0.25 inch to about 0.5 inch.

8. The louvered fin of claim 1, wherein a distance between two adjacent holes of the first set of holes is in a range of about 1 inch to about 0.75 inch.

9. The louvered fin of claim 1, wherein a distance between two adjacent holes of the second set of holes is in a range of about 1 inch to about 0.75 inch.

10. The louvered fin of claim 1, wherein the first offset distance between the first axis and the second set of holes is in a range of about 0.375 inch to about 0.5 inch.

11. The louvered fin of claim 1, wherein a diameter of each hole of the first set of holes, the second set of holes, and the third set of holes is in a range of about 6.8 mm to about 4.8 mm.

12. The louvered fin of claim 1 further comprising a plurality of collars, wherein each collar extends from a periphery of one hole of the plurality of holes.

13. The louvered fin of claim 12, wherein each collar extends in a direction perpendicular to the surface of the louvered fin.

14. The louvered fin of claim 12, wherein each collar comprises a narrow portion and an expanded portion, the expanded portion being distal from the surface of the louvered fin.

15. An evaporator coil comprising:

a plurality of refrigerant tubes; and a plurality of louvered fins, wherein each louvered fin comprises:

a leading edge;

a trailing edge opposite to the leading edge; and a surface extending between the leading edge and the trailing edge, the surface defining a plurality of holes configured to allow the plurality of refrigerant tubes to pass therethrough, wherein:

a first set of holes are defined along a first axis;

a second set of holes are defined along a second axis wherein the second set of holes are offset from the first set of holes along (i) a longitudinal axis of the louvered fin by a first offset distance, and (ii) a latitudinal axis of the louvered fin by a second offset distance; and a third set of holes are defined along a third axis, wherein the third set of holes are offset from the second set of holes along (i) the longitudinal axis of the louvered fin by a third offset distance and (ii) the latitudinal axis of the louvered fin by a fourth offset distance, wherein the first offset distance is greater than the third offset distance, and wherein the fourth offset distance is greater than the second offset distance, and wherein the first axis, the second axis, and the third axis extend substantially parallel to the longitudinal axis of the louvered fin; and wherein the second set of holes and the third set of holes define a substantially obtuse trapezoidal matrix.

16. The evaporator coil of claim 15, wherein each of the plurality of louvered fins is made from aluminum alloy.

17. The evaporator coil of claim 15, wherein each of the plurality of holes forms an interference fit with an outer surface of a refrigerant tube passing therethrough.

18. The evaporator coil of claim 15, wherein each of the plurality of louvered fins defines at least one cropped corner.

19. The evaporator coil of claim 18 further comprising gagged regions located around peripheries of the hole defined proximal to the at least one cropped corner.

20. The evaporator coil of claim 15 further comprising a plurality of collars, wherein each collar extends from a periphery of one hole of the plurality of holes, and wherein a length of each collar is in a range of about 1.4 mm to about 1.8 mm.

* * * * *